US009232858B2

(12) United States Patent
Scholz

(10) Patent No.: US 9,232,858 B2
(45) Date of Patent: Jan. 12, 2016

(54) STABILIZER BRACKET FOR A RACK FOR SUPPORTING OBJECTS

(76) Inventor: Gottfried Scholz, Biederthal (FR)

( * ) Notice: Subject to any disclaimer, the term of this patent is extended or adjusted under 35 U.S.C. 154(b) by 254 days.

(21) Appl. No.: 13/884,274

(22) PCT Filed: Jan. 3, 2011

(86) PCT No.: PCT/EP2011/050001

§ 371 (c)(1),
(2), (4) Date: May 9, 2013

(87) PCT Pub. No.: WO2012/092955

PCT Pub. Date: Jul. 12, 2012

(65) Prior Publication Data

US 2013/0228661 A1 Sep. 5, 2013

(51) Int. Cl.

| | |
|---|---|
| ***A47B 96/06*** | (2006.01) |
| ***A47B 57/06*** | (2006.01) |
| ***A47B 57/30*** | (2006.01) |
| ***A47B 57/40*** | (2006.01) |
| *A47B 96/14* | (2006.01) |

(52) U.S. Cl.

CPC ..... *A47B 96/06* (2013.01); *A47B 57/06* (2013.01); *A47B 57/30* (2013.01); *A47B 57/406* (2013.01); *A47B 2096/1491* (2013.01)

(58) Field of Classification Search

CPC .... A47B 57/406; A47B 57/402; A47B 57/40; A47B 96/1441; A47B 96/06; A47B 57/50; A47B 47/00; A47B 47/0083; A47B 47/02; A47B 47/021; A47B 47/028; A47B 47/03; A47B 47/045; A47B 57/06; A47B 57/16; A47B 57/20; A47B 57/22; A47B 57/30; A47B 57/42; A47B 57/48

USPC ..... 108/107; 211/187, 189, 182, 191, 192, 211/183, 175, 188, 190, 134; 248/243, 300, 248/220.21

See application file for complete search history.

(56) References Cited

U.S. PATENT DOCUMENTS

| | | | | | |
|---|---|---|---|---|---|
| 2,907,471 | A | * | 10/1959 | Henry | A47B 57/404 108/109 |
| 3,261,585 | A | * | 7/1966 | Costantini et al. | 248/243 |
| 3,263,821 | A | * | 8/1966 | Klene et al. | 211/190 |
| 3,487,790 | A | * | 1/1970 | Rous | A47B 7/402 108/107 |
| 3,608,504 | A | * | 9/1971 | Peters | A47B 57/30 108/109 |

(Continued)

FOREIGN PATENT DOCUMENTS

| | | | |
|---|---|---|---|
| DE | 1178564 | B | 9/1964 |
| DE | 10148174 | A1 | 4/2003 |
| DE | 10160364 | A1 | 7/2003 |

*Primary Examiner* — Joshua Rodden
*Assistant Examiner* — Hiwot Tefera
(74) *Attorney, Agent, or Firm* — Michael Soderman

(57) ABSTRACT

The invention concerns a stabilizer shoe (13) intended for a shelf (1) for storing objects, which has on its corner points vertical longitudinal posts (2) with lockable recesses (7). Into which a strut (8) provided with mounting hooks (12) is suspended, which possesses a prestressed, open upward retaining pocket (10), in which one or several shelf bottoms (3) are held in a self-clamping manner. The stabilizer shoe (13) is designed as a separate one-piece component and substantially in the form of an L. One branch (14) is designed flat and is inserted between the longitudinal post (2) and the strut (8). The other branch (15) has respectively a right-angled folded edge (17) at its opposed longitudinal sides and hence forms a U-shaped profile (18), into which the longitudinal external side (4) of a shelf bottom (3) is inserted.

7 Claims, 4 Drawing Sheets

(56) References Cited

U.S. PATENT DOCUMENTS

| | | | | | |
|---|---|---|---|---|---|
| 4,154,419 | A * | 5/1979 | Breidenbach | 248/243 | |
| 4,189,250 | A * | 2/1980 | Abbott et al. | 403/190 | |
| 4,201,139 | A * | 5/1980 | Suttles | 108/109 | |
| 4,317,523 | A * | 3/1982 | Konstant et al. | 211/187 | |
| 4,342,397 | A * | 8/1982 | Halstrick | 211/191 | |
| 4,366,910 | A * | 1/1983 | Uccello et al. | 211/191 | |
| 4,955,743 | A * | 9/1990 | King | 403/254 | |
| 5,377,851 | A * | 1/1995 | Asano et al. | 211/191 | |
| 5,433,327 | A * | 7/1995 | Benvenuti et al. | 211/193 | |
| 5,791,498 | A * | 8/1998 | Mills | 211/26 | |
| 6,230,910 | B1 * | 5/2001 | Olsson et al. | 211/192 | |
| 6,920,831 | B2 * | 7/2005 | Lin | 108/107 | |
| 7,406,920 | B2 * | 8/2008 | Scholz | A47B 96/1441 108/107 | |
| 9,167,896 | B1 * | 10/2015 | Wu | A47B 57/36 | |
| 2004/0084584 | A1 * | 5/2004 | Lin | 248/235 | |
| 2005/0111912 | A1 * | 5/2005 | Brain et al. | 403/353 | |

* cited by examiner

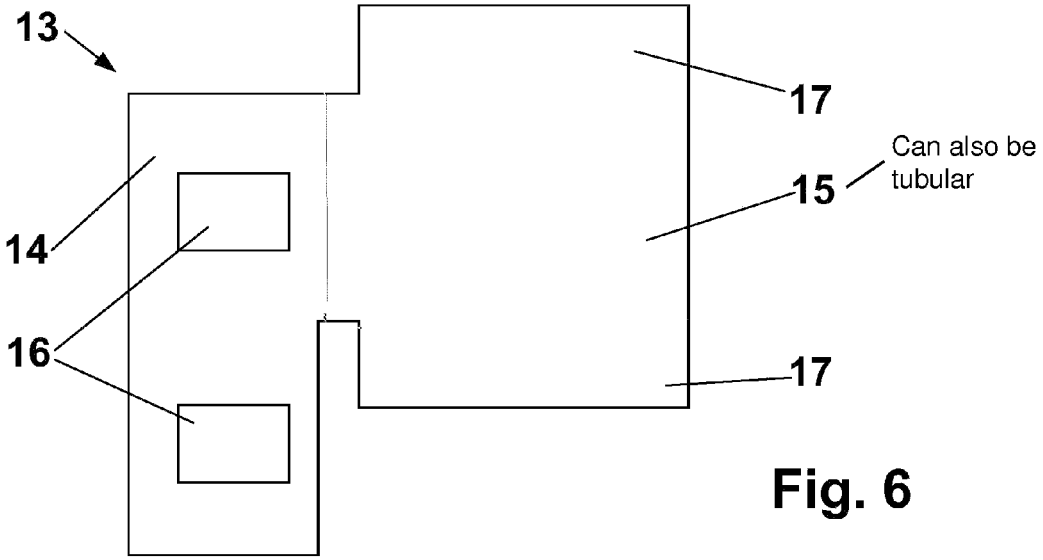
Fig. 6
Fig. 7
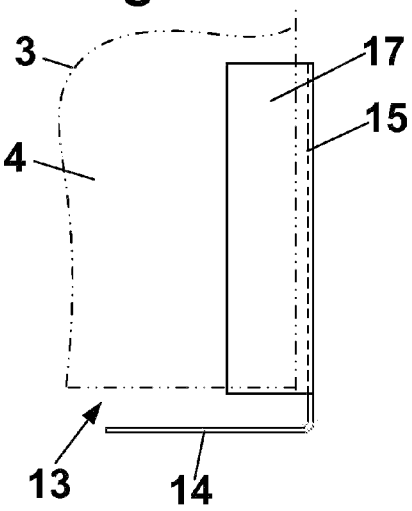
Fig. 8
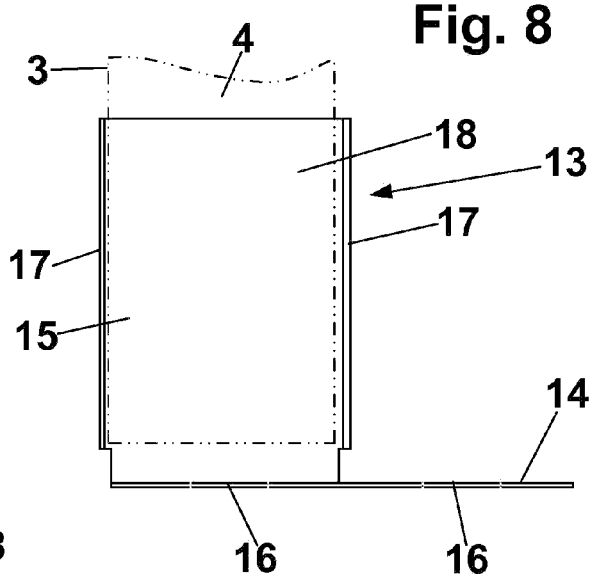
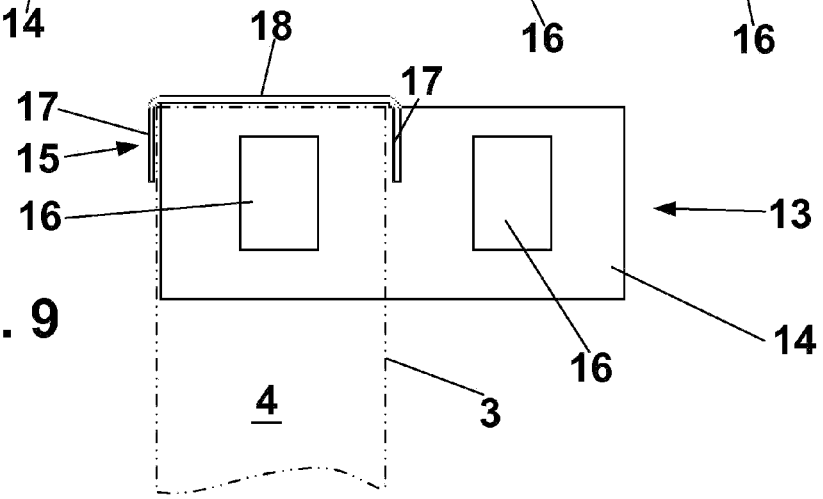
Fig. 9

STABILIZER BRACKET FOR A RACK FOR SUPPORTING OBJECTS

CROSS REFERENCE TO RELATED APPLICATIONS

This application is the U.S. national stage of International Application No. PCT/EP2011/050001, filed on Jan. 3, 2011, and claims the benefit thereof. The application is herein incorporated by reference in its entirety.

BACKGROUND

The invention concerns a stabilizer bracket intended for a shelf for storing objects, which has on its corner points vertical longitudinal posts with lockable recesses, into which a strut provided with mounting hooks is suspended, which possesses a prestressed, open upward retaining pocket, in which one or several shelf bottoms are held in a self-clamping manner.

A large number of shelves or shelving systems are known, whose individual parts, such as longitudinal posts, side ladders or struts and shelf bottoms are connected to each other by means of different fastening types. Such shelves usually present several longitudinal posts on the shelf corner points to which one or several horizontal shelf bottoms are fastened at certain vertical distances on which objects and/or bulk goods are stored.

The shortcoming of such shelves or shelving systems is that said elements cannot be disassembled any longer depending on the type of connection, for example by welding or gluing, nor adapted to suit the users' requirements. Thus, said shelves or shelving systems still present a high stability, however the variation in size and number of the shelf bottoms in the shelf or shelving system is strongly limited. Moreover, these shelves or shelving systems are difficult to transport due to the space required by the fixed connection.

Moreover, a large number of shelves or shelving systems are known, in which the shelving parts, such as shelf bottoms, longitudinal posts, struts etc. are joined for example using groove-spring-connections. With certain systems, the shelf bottoms are simply laid on stays or pins on the struts. This provides high instability of the shelving system. Screwed shelves or shelving systems which are connected by special connection elements can only assembled or disassembled at great expense so that said people in charge have assembly or disassembly problems. Additionally, connection elements whose design is often complicated are necessary for connecting the shelf bottoms, whose manufacturing technique is tricky.

Documents EP 101 48 174 A1 and EP 101 60 364 A1 disclose a shelving system, comprising at least one shelf, in which struts for fastening shelf bottoms are arranged between respectively two front-sided longitudinal posts. The longitudinal posts present recesses for receiving pairs of hooks spaced apart vertically and horizontally and directed downwards on the struts. To do so, a downward directed front tab of the shelf bottom is clenched between the strut and the longitudinal posts of the shelf which support said strut to prevent said shelf bottom from being lifted.

Since such a shelf or shelving system operates as such without screw connections and without using any tool, stability can only be achieved inasmuch that the rear longitudinal posts are connected to each other through several stays extending diagonally and crossing each other, generally on the back of the shelf. The production and the assembly of these stays is not only material intensive and costly, but these are also optically unattractive. Moreover, the most various gusset plates and pieces are used to increase the stability of a shelf.

SUMMARY

The invention concerns a stabilizer bracket (13) intended for a shelf (1) for storing objects, which has on its corner points vertical longitudinal posts (2) with lock-able recesses (7). Into which a strut (8) provided with mounting hooks (12) is suspended, which possesses a pre-stressed, open upward retaining pocket (10), in which one or several shelf bottoms (3) are held in a self-clamping manner. The stabilizer bracket (13) is designed as a separate one-piece component and substantially in the form of an L. One branch (14) is designed flat and is inserted between the longitudinal post (2) and the strut (8). The other branch (15) has respectively a right-angled folded edge (17) at its opposed longitudinal sides and hence forms a U-shaped profile (18), into which the longitudinal external side (4) of a shelf bot-tom (3) is inserted.

DETAILED DESCRIPTION

It is an object of the invention to provide to provide a stabilizer bracket of the type above mentioned, which enables to dispense with other stabilisation elements such as cross braces and similar and still guarantees a high stability of the shelf without having to use screw connections and the like as well as tools.

The object is met by the invention inasmuch as the stabilizer bracket 13 is designed as a separate one-piece component and substantially in the form of an L, whereas one branch 14 is designed flat and is inserted between the longitudinal post 2 and the strut 8, and the other branch 15 has respectively a right-angled folded edge 17 at its opposed longitudinal sides and hence forms a U-shaped profile, into which the longitudinal external side of a shelf bottom is inserted and clamped.

The stabilizer bracket according to the invention is in particular suitable for a shelf or shelving system, in which at least one strut is used, which for instance comprises pairs of mounting hooks and which possesses a prestressed, open upward retaining pocket, in which one or several shelf bottoms are held in a self-clamping manner. To do so, the shelf bottoms are inserted with the front face into the narrow gap of the retaining pocket of the strut. For that purpose, the shelf bottoms can be shifted back and forth, that is to say forwards and backwards relative to the depth of the shelf. With the shelf or shelving system, the shelf bottoms can also consist of a plurality of narrow shelf bottoms in the depth of the shelf.

The one-piece stabilizer bracket is a separate component, whereas the flatly designed branch is simply clamped with the strut on the longitudinal post through the contact pressure.

According to a further embodiment of the stabilizer bracket according to the invention, at least one pair of holes matching the recesses of the longitudinal post in a locking manner is formed on the flatly designed branch.

The mounting hooks of the strut push in the stabilizer bracket provided with the corresponding holes between longitudinal post and strut, whereas the flatly designed branch with said at least one pair of holes matching the recesses of the longitudinal post in a locking manner is adapted to the strut. To do so, the mounting hooks of the strut protrude through the holes, which are congruent thereto, of the flatly designed branch. Consequently, the branch with said at least one pair of holes formed to match the recesses of the longitudinal post in a locking manner is clamped between the strut and the longitudinal post, whereas the mounting hooks of the strut protrude through the holes of the branch.

The other branch then forms with the U-shaped profiled folded edge the bracket for the associated shelf bottom. In so doing, the U-shaped profiled folded edge enables to stabilise the shelf and also the shelf bottom which is inserted therein. The stabilizer bracket can be designed larger, longer or thicker according to the necessary bearing capacity of the shelf bottoms in the shelf.

With the stabilizer bracket, the shelf bottom is inserted in the direction of its respective outside into the U-shaped profiled folded edge on the one branch. Preferably, at least three shelf bottoms are always necessary to that end. An external shelf bottom is pushed into the stabilizer bracket with the longitudinal external side respectively and one or several shelf bottoms are inserted therebetween from above into the retaining pocket of the strut. The assembly takes place without screw connections and completely without tools. This achieves a high stability of the shelf inasmuch that the longitudinal external side of the shelf bottom is held at least partially over a certain portion in the U-shaped profiled folded edge of the one branch of the stabilizer bracket.

According to a further embodiment of the stabilizer bracket, the branch extends with the U-shaped profiled folded edge over the whole shelf width or length of the shelf bottom and in turn has on the other end a flatly designed branch of a further stabilizer bracket and this branch is inserted between the longitudinal post and the strut and the longitudinal external side of a shelf bottom is inserted into whose U-shaped profiled folded edge.

Consequently, the stabilizer bracket can extend over the whole shelf width so that the shelf bottom is captured at its longitudinal external side completely by the U-shaped profiled folded edge of the branch. The shelf is hence stabilised even more strongly, similarly to the shelf bottom inserted therein, which moreover is also protected against deflection further to the load induced by objects stored thereon. If necessary, this branch can also extend only partially over the longitudinal external side of the shelf bottom. But the stabilizer bracket extending over the whole shelf width can also serve as a carrier, for instance for tyres and vehicle wheels. To that end, the other branch should not absolutely have a U-shaped profiled folded edge but may take on other possible shapes for such a purpose. for instance a tubular shape with round or square cross section.

The object is satisfied alternately in that the stabilizer bracket has a branch, which has respectively a right-angled folded edge at its opposed longitudinal sides and hence forms a U-shaped profile, into which the longitudinal external side of a shelf bottom is inserted, and that the branch with the U-shaped folded edges at its opposed longitudinal sides is integral part of the strut or of the longitudinal post, whereas the branch is designed right-angled and horizontal, protruding away therefrom.

Consequently, the stabilizer bracket is for instance part of the strut. Which means that a stabilizer bracket is respectively with the matching branch is formed with the U-shaped profiled folded edge running at right angle with respect to the strut at each side of the strut. If the stabilizer bracket with said matching branch is integral part of a longitudinal post, with the U-shaped profiled folded edge running at right angle to the longitudinal post, two opposite longitudinal posts on a front side of the shelf are each fitted with such a branch as a stabilizer bracket. Consequently, the stabilizer bracket is incorporated into the strut or the longitudinal post. As regards the branch with the U-shaped profiled folded edge, all the features and advantages already described for obtaining the stabilizer bracket as a separate one-piece component, are still valid.

Also with said embodiment of the stabilizer bracket, the branch can extend with the U-shaped profiled folded edge over the whole shelf width or length of the shelf bottom and turns into the strut or the longitudinal post on the other end, as already described relative to the stabilizer bracket as a separate one-piece component. If necessary, the branch can be connected to the U-shaped profiled folded edge and the matching strut for instance by means of plugged, screwed or riveted connections.

It goes without saying that the features aforementioned and those still to be explained below cannot solely be applied in the given combination, but also in other combinations or individually without departing from the framework of the present invention.

BRIEF DESCRIPTION OF THE DRAWINGS

The idea behind the invention will be illustrated more in detail in the following description using an exemplary embodiment, which is illustrated in the drawings. Wherein FIG. 6 shows a development of the stabilizer bracket according to the invention for use in a shelf, FIGS. 7 to 9 show different view of the stabilizer bracket according to FIG. 6

DETAILED DESCRIPTION OF THE PREFERRED EMBODIMENT

Figure 1:
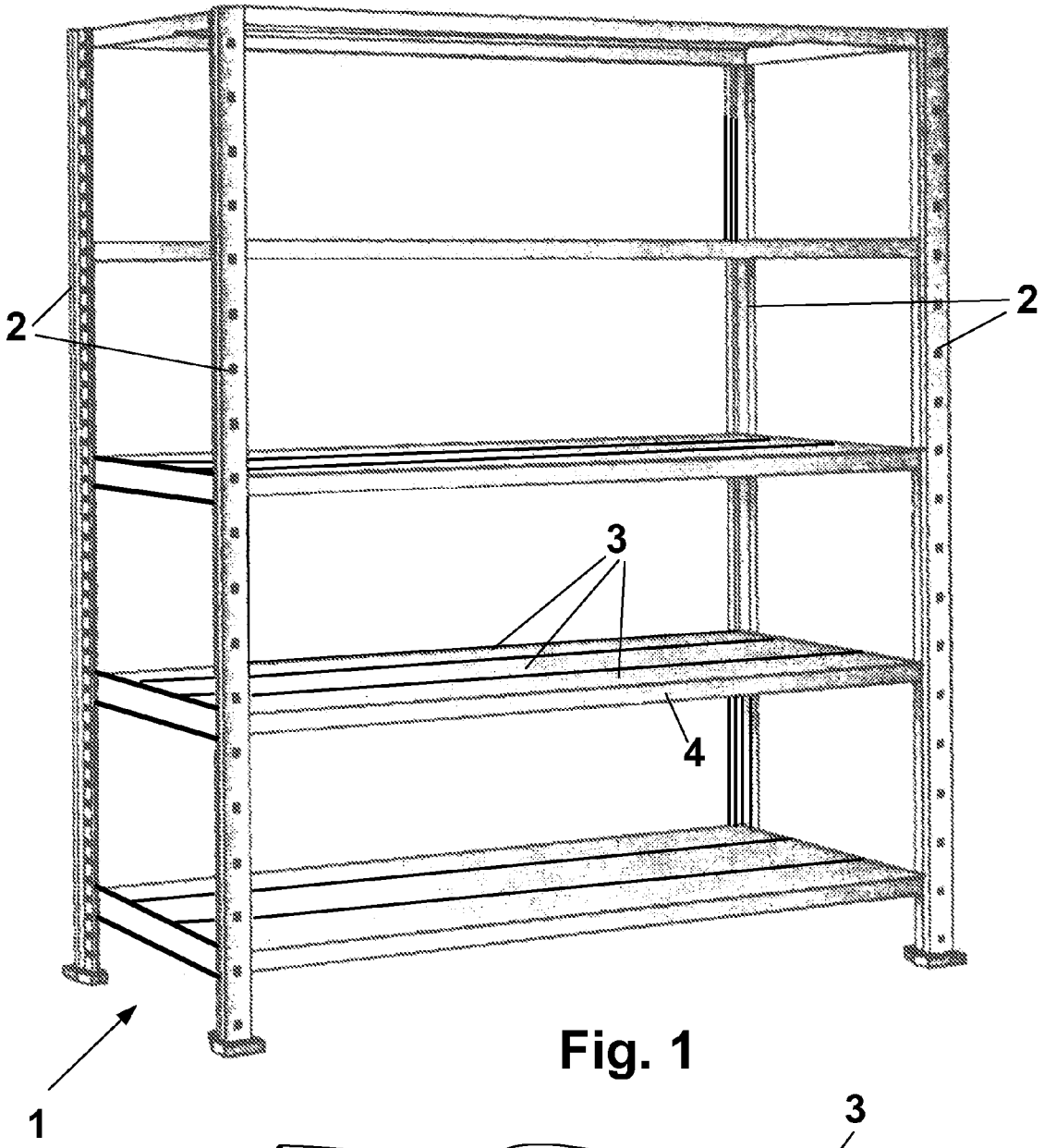
FIG. 1 is a perspective view of a shelf for storing objects.

FIG. 1 shows a shelf 1, which has a rectangular contour, and preferably consists completely of a metal sheeting material. A vertical longitudinal post 2 is situated on each of the corner points of the shelf 1. Moreover, the respective front-sided pairs of longitudinal posts 2 are connected to one another through three shelf bottoms 3 situated horizontally against one another, on which non shown objects of all type are stored.

Figure 2:
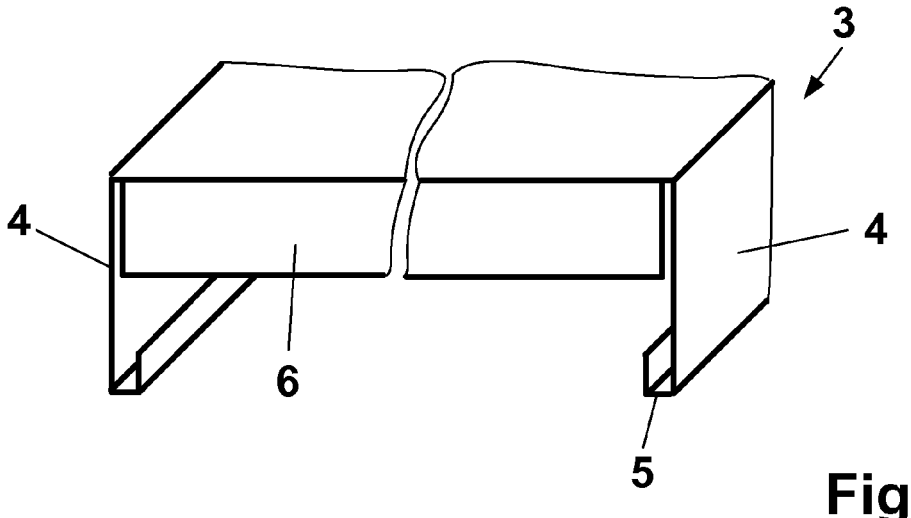
FIG. 2 is a partial perspective view of a shelf bottom for a shelf according to FIG. 1.

FIG. 2 shows a perspective partial view of the shelf bottom 3. A longitudinal side wall 4 reaching downwards is articulated on each of its longitudinal sides. The lower free end of the longitudinal side wall 4 includes a groove-shaped folded edge 5. A downward reaching front tab 6 is articulated on the front sides of the shelf bottom 3 and is provided for clamping its front sides between the longitudinal posts 2 of the shelf 1 and the struts.

Figure 3:
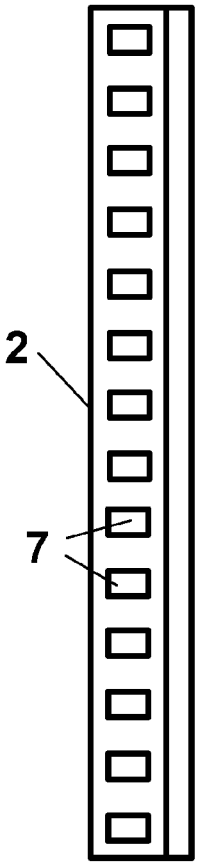
FIG. 3 is a side view of a longitudinal post for a shelf according to FIG. 1.
Figure 4:
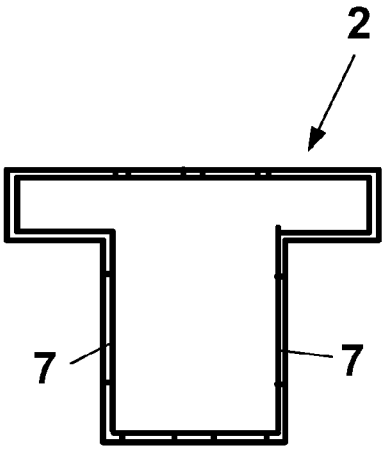
FIG. 4 is a cross sectional view of the longitudinal post according to FIG. 3.

FIGS. 3 and 4 show a longitudinal post 2 of the shelf 1. Said post presents on its front side spaced apart recesses 7 in a locking manner. As shown moreover in FIG. 4, the longitudinal post 2 is formed of a rolled hollow profile made of flat strip material and is consequently more or less T-shaped.

Figure 5:
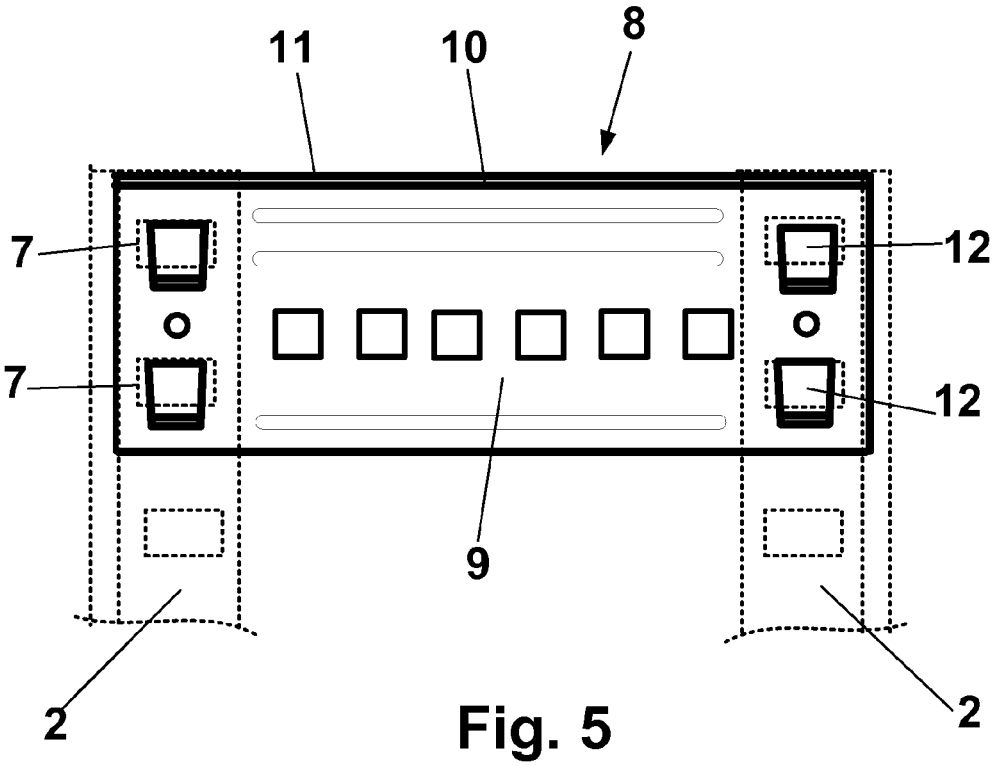
FIG. 5 is a side view of a strut for a shelf according to FIG. 1.
Figure 10:
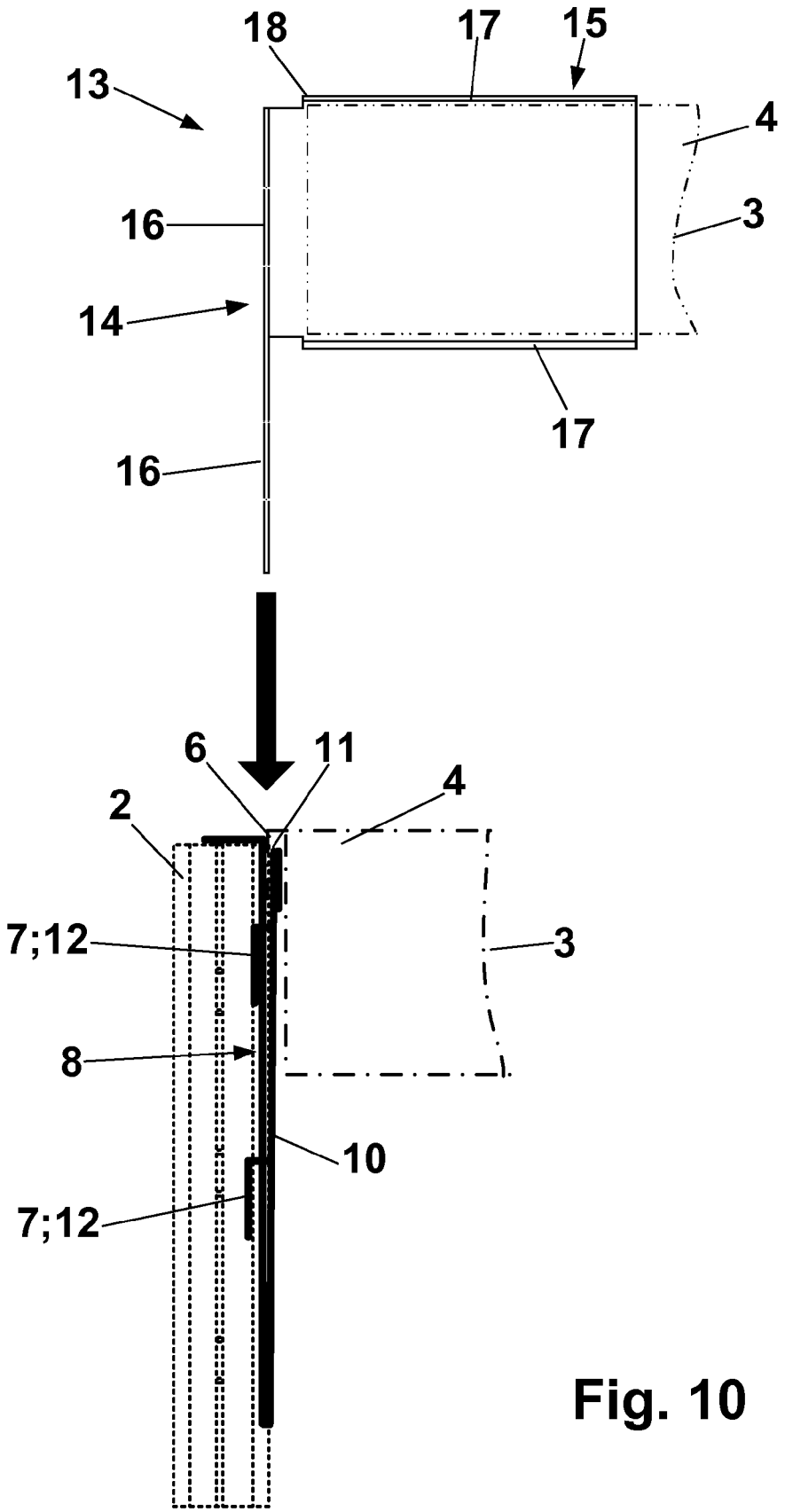
FIG. 10 shows a stabilizer bracket inserted into a strut and a longitudinal post.

FIG. 5 is shows a strut 8 for a shelf 1, which is inserted between two spaced apart longitudinal posts 2, arranged at the front of the shelf 1. The strut 8 possesses a basic component 9, in the form of an open upward retaining pocket 10, as illustrated in FIG. 10, with an upper horizontal supporting edge 11, on which the lower side of the shelf bottom can rest once inserted. A pair of downward directed horizontal and vertical mounting hooks 12, which are spaced apart relative to one another, are each formed at the rim sections of the strut 8. The mounting hooks 12 mesh into the recesses 7 of the longitudinal posts 2 of the shelf 1. The front tab 6 of the shelf bottom 3 is inserted into the open upward retaining pocket 10 of the strut 8, so that the shelf bottom 3 is clamped reliably between the strut 8 and the longitudinal posts 2. If the strut 8 has no retaining pocket, the front tab 6 of the shelf bottom 3 is clamped directly between the strut 8 and the longitudinal posts 2.

FIG. 6 shows a stabilizer bracket 13 which is designed as a separate one-piece component. Consequently, the bending edges of the development are represented in dash-dash lines. If the development of the stabilizer bracket 13 is bent said bracket is substantially L-shaped with a first branch 14 and a second branch 15 bent at right angle thereto. A pair of holes 16 formed to match the recesses 7 of the longitudinal post 2 in a locking manner is clamped an the branch 14 for accessing the pairs of mounting hooks 12 of the strut 8. The first branch 14 is consequently inserted between the corresponding longitudinal post 2 and the corresponding strut 8. The second branch 15 has respectively a right-angled folded edge 17 at its opposed longitudinal sides. This enables to obtain a U-shaped profile 18, into which the longitudinal external side 4 of the shelf bottom 3 is inserted.

FIG. 10 first of all shows in the lower section a longitudinal post 2 of the shelf 1, at which a strut 8 is fastened in such a way that its mounting hooks 12 mesh into the recesses 7 in the longitudinal post 2. A front tab 6 of a shelf bottom 8 is inserted into the open upward retaining pocket 10 of the strut 8, which represented in dash-dot-dot-dash lines. A stabilizer bracket 13 is shown in the upper section of FIG. 10, which is inserted into the retaining pocket 10 of the strut 10 in such a way that the holes in the branch 14 of the stabilizer bracket 13 are congruent with the recesses 7 in the longitudinal post 2 and penetrated by the mounting hooks 12 of the strut 8. The longitudinal external side 4 of a shelf bottom 3 is hence inserted into the U-shaped profiled folded edge 17 of the branch 15, which is stabilised together with the whole shelf 1 through the U-shaped profile 18 of the branch 15.

LIST OF REFERENCE NUMERALS

1 Shelf
2 Longitudinal post
3 Shelf bottom
4 Longitudinal side wall, longitudinal external side
5 Folded edge
6 Front tab
7 Recess
8 Strut
9 Basic component
10 Retaining pocket
11 Supporting edge
12 Mounting hook
13 Stabilizer bracket
14 First branch
15 Second branch, can also be tubular
16 Holes
17 Folded edge
18 U-shaped profile

The invention claimed is:

1. A shelf (1) for storing objects, including a stabilizer bracket (13) in the form of a separate one-piece component and substantially in the form of an L shape, whereas a first branch (14) of the stabilizer bracket is flat and is inserted between a vertical longitudinal post (2) of the shelf (1) for storing objects and a strut (8) provided with downward directed, L-shaped mounting hooks, said first branch making contact on one side with the vertical longitudinal post (2) and the strut (8) on the other side, said mounting hooks of the strut extending through holes of the first branch matching the recesses of the longitudinal post and further through the lockable recesses of the longitudinal post, clamping the first branch in place, and a second branch (15) of the stabilizer bracket angling off one end of the first branch has respectively a right-angled folded edge (17) at its opposed longitudinal sides and hence forms a U-shaped profile (18), into which a longitudinal external side (4) of a shelf bottom (3) is inserted and clamped.

2. A shelf for storing objects according to claim 1, wherein the second branch (15) of the stabilizer bracket extends with the U-shaped profiled folded edge (17) over the whole length of the shelf bottom (3).

3. A shelf (1) for storing objects, including a stabilizer bracket (13) in the form of a separate one-piece component and substantially in the form of an L shape, whereas a first branch (14) of the stabilizer bracket is flat and is inserted between a vertical longitudinal post (2) of the shelf (1) for storing objects and a strut (8) provided with downward directed, L-shaped mounting hooks, said first branch making contact on one side with the vertical longitudinal post (2) and the strut (8) on the other side, said mounting hooks of the strut extending through holes of the first branch matching the recesses of the longitudinal post and further through the lockable recesses of the longitudinal post, clamping the first branch in place, and a second branch (15) of the stabilizer bracket angling off one end of the first branch has respectively a right-angled folded edge (17) at its opposed longitudinal sides and hence forms a U-shaped profile (18), into which a longitudinal external side (4) of a shelf bottom (3) is inserted and clamped, and wherein the second branch (15) extends with the U-shaped profiled folded edge (17) over the whole shelf width or length of the shelf bottom (3) and serves as a carrier.

4. A shelf for storing objects according to claim 3, wherein the carrier is used for tires and vehicle wheels.

5. A shelf (1) for storing objects, including a stabilizer bracket (13) in the form of a separate one-piece component and substantially in the form of an L shape, whereas a first branch (14) of the stabilizer bracket is flat and is inserted between a vertical longitudinal post (2) of the shelf (1) for storing objects and a strut (8) provided with downward directed, L-shaped mounting hooks, said first branch making contact on one side with the vertical longitudinal post (2) and the strut (8) on the other side, said mounting hooks of the strut extending through holes of the first branch matching the recesses of the longitudinal post and further through the lockable recesses of the longitudinal post, clamping the first branch in place, and a second branch (15) of the stabilizer bracket angling off one end of the first branch has a tubular shape, and wherein the second branch (15) extends with the tubular shape over the whole shelf width or length of the shelf bottom (3) and serves as a carrier.

6. A shelf for storing objects according to claim 5, wherein the tubular shape of the stabilizer bracket has a round cross section.

7. A shelf for storing objects according to claim 5, wherein the tubular shape of the stabilizer bracket has a square cross section.

* * * * *